US012653372B2

(12) United States Patent
Kim et al.

(10) Patent No.: US 12,653,372 B2
(45) Date of Patent: Jun. 16, 2026

(54) SHOE CARE APPARATUS

(71) Applicant: SAMSUNG ELECTRONICS CO., LTD., Suwon-si (KR)

(72) Inventors: Daegeon Kim, Suwon-si (KR); Hakjae Lee, Suwon-si (KR); Jinyounggeul Oh, Suwon-si (KR); Jeoungkyo Jeoung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 689 days.

(21) Appl. No.: 18/107,254

(22) Filed: Feb. 8, 2023

(65) Prior Publication Data

US 2023/0180994 A1 Jun. 15, 2023

Related U.S. Application Data

(63) Continuation of application No. PCT/KR2021/008065, filed on Jun. 28, 2021.

(30) Foreign Application Priority Data

Aug. 21, 2020 (KR) ..... 10-2020-0105219

(51) Int. Cl.
*A47L 23/20* (2006.01)
*A47L 23/18* (2006.01)

(52) U.S. Cl.
CPC ..... *A47L 23/20* (2013.01); *A47L 23/18* (2013.01)

(58) Field of Classification Search
CPC ..... A47L 23/20; A47L 23/18; A47L 23/205; A47L 23/02; F26B 21/008; F26B 21/086; F26B 21/028; F26B 21/06; A43D 3/1408
USPC ..... 34/440, 439, 106, 104, 437
See application file for complete search history.

(56) References Cited

U.S. PATENT DOCUMENTS

| | | | | |
|---|---|---|---|---|
| 3,793,744 | A | 2/1974 | Saita | |
| 4,136,464 | A | 1/1979 | Hay | |
| 12,256,880 | B2 * | 3/2025 | Yoo | A47B 61/04 |
| 2022/0313061 | A1 | 10/2022 | Kim et al. | |

FOREIGN PATENT DOCUMENTS

| | | |
|---|---|---|
| JP | S59-204 B2 | 1/1984 |
| JP | 7-269895 | 10/1995 |
| JP | 2002-136466 | 5/2002 |

(Continued)

OTHER PUBLICATIONS

Human translation of JPS59204B2 (Year: 2025).*

(Continued)

*Primary Examiner* — John P Mccormack
(74) *Attorney, Agent, or Firm* — STAAS & HALSEY LLP

(57) ABSTRACT

A shoe care apparatus including a cabinet forming a care chamber and including a supply port; a supply duct provided to supply air to the care chamber through the supply port; a supporter rail; and a supporter to support a shoe, and being detachably mountable to the supporter rail in the care chamber. The supporter rail and supporter may be configured so that the supply port is opened in response to the supporter being mounted to the supporter rail, and the supporter receives the air supplied through the supply port, and the supply port is closed in response to the supporter being separated from the supporter rail.

16 Claims, 17 Drawing Sheets

(56) References Cited

FOREIGN PATENT DOCUMENTS

| | | |
|---|---|---|
| JP | 3767301 | 4/2006 |
| JP | 2014-87577 | 5/2014 |
| KR | 10-0175866 | 10/1999 |
| KR | 20-0270578 | 4/2002 |
| KR | 10-0529801 | 11/2005 |
| KR | 20-0427783 | 9/2006 |
| KR | 20-2007-0000354 | 3/2007 |
| KR | 10-2014-0107876 | 9/2014 |
| KR | 10-2016-0037713 | 4/2016 |
| KR | 10-2016-0117978 | 10/2016 |
| KR | 20-0481915 | 11/2016 |
| KR | 20-2018-0001463 | 5/2018 |
| KR | 10-2166463 | 10/2020 |
| KR | 10-2021-0030856 | 3/2021 |
| KR | 10-2021-0085188 | 7/2021 |
| WO | WO 2010/149343 A1 | 12/2010 |

OTHER PUBLICATIONS

International Search Report, PCT/ISA/210, dated Oct. 19, 2021, in PCT Application No. PCT/KR2021/008065.
Written Opinion, PCT/ISA/237, dated Oct. 19, 2021, in PCT Application No. PCT/KR2021/008065.
European Office Action dated Oct. 17, 2024 for European Patent Application No. 21 858 465.4.
Korean Office Action dated Aug. 1, 2024 for Korean Patent Application No. 10-2020-0105219.

* cited by examiner

SHOE CARE APPARATUS

CROSS-REFERENCE TO RELATED APPLICATIONS

This application is a continuation application under 35 U.S.C. § 111(a) of international Application No. PCT/KR2021/008065, filed on Jun. 28, 2021, which claims priority to Korean Patent Application No. 10-2020-0105219, filed on Aug. 21, 2020, the disclosures of which are incorporated by reference herein in their entireties.

BACKGROUND

1. Field

The present disclosure relates to a shoe care apparatus, and more particularly, to a shoe care apparatus including a blowing flow path.

2. Description of the Related Art

Shoes are worn on the feet when walking or exercising, and the shoes may be contaminated by soil or dirt, and may also be contaminated by sweat. Therefore, it is required to periodically wash the shoes for the comfortable use. However, because shoes include a part that directly touches the floor, a degree of contamination is typically greater than that of clothes and thus it is difficult to wash the shoes and the clothes together.

In addition, unlike general clothes, shoes include various parts such as an upper, a midsole, an outsole, an insole, a tongue, a heel cup, and a heeltap. Further, according to the purpose of each part, various materials may be applied to each part. For example, a relatively hard material may be applied to a midsole, an outsole, and/or a heel cup, and a relatively soft material may be applied to an insole and a heel tab. Shoes have a relatively complex structure, and thus it is not easy to care for the shoes with a conventional clothes care apparatus.

In addition, as the size of the resell market for limited edition shoes has recently increased, consumers' interest in the limited-edition shoes is increased, and there is a growing need of a device for easy care for the limited-edition shoes.

SUMMARY

Aspects of embodiments of the disclosure will be set forth in part in the description which follows and, in part, will be apparent from the description, or may be learned by practice of the presented embodiments.

According to an embodiment of the disclosure, a shoe care apparatus may include a cabinet forming a care chamber and including a supply port; a supply duct provided to supply air to the care chamber through the supply port; a supporter rail; and a supporter to support a shoe, and being detachably mountable to the supporter rail in the care chamber. The supporter rail and supporter may be configured so that the supply port is opened in response to the supporter being mounted to the supporter rail, and the supporter receives the air supplied through the supply port, and the supply port is closed in response to the supporter being separated from the supporter rail.

According to an embodiment of the disclosure, the supporter rail includes a rail body fixed to the cabinet, and a supply door coupled to the rail body so as to be rotatable to open the supply port and close the supply port.

According to an embodiment of the disclosure, the supporter rail further includes an elastic body provided to apply an elastic force to the supply door in a direction to close the supply port.

According to an embodiment of the disclosure, the supply door further includes a weight member arranged on a lower end of the supply door so as to rotate the supply door in a direction to close the supply port.

According to an embodiment of the disclosure, the supporter rail includes a trigger provided to be pressed by the supporter so as to rotate the supply door in a direction to open the supply port in response to the supporter being mounted to the supporter rail.

According to an embodiment of the disclosure, the trigger includes a member formed to extend from the supply door in a direction in which air is discharged from the supply port, and to be inclined in a direction along which the supporter moves while being mounted to the supporter rail.

According to an embodiment of the disclosure, the trigger is arranged at a rear end of the supply door with respect to a direction along which the supporter moves while being mounted to the supporter rail.

According to an embodiment of the disclosure, the trigger includes a first member, and a second member formed to protrude further from the supply door than the first member.

According to an embodiment of the disclosure, the supporter rail includes a rail body fixed to the cabinet, and a supply door coupled to the rail body so as to be slidable to open the supply port and close the supply port.

According to an embodiment of the disclosure, the supply door includes a first shutter including a lever provided to be pressed by the supporter in response to mounting the supporter to the supporter rail, and a second shutter slidably coupled to the first shutter.

According to an embodiment of the disclosure, the supporter includes a pressing member provided to press the lever, and at least one of a magnet and a magnetic material disposed in the pressing member, wherein at least one of the magnetic material and the magnet is provided in the lever to apply an attractive force between the lever and the pressing member.

According to an embodiment of the disclosure, the first shutter includes a hook provided to interfere with a portion of the second shutter to prevent the first shutter from being separated from the second shutter when the supporter is being separated from the supporter rail.

According to an embodiment of the disclosure, the first shutter is provided to overlap the second shutter in response to the supply port being opened as the supporter is mounted on the supporter rail.

According to an embodiment of the disclosure, the rail body includes a door supporting member provided to support the supply door so as to be slidable.

BRIEF DESCRIPTION OF THE DRAWINGS

These and/or other embodiments of the disclosure will become apparent and more readily appreciated from the following description of the embodiments, taken in conjunction with the accompanying drawings of which.

DETAILED DESCRIPTION

Figure 1:
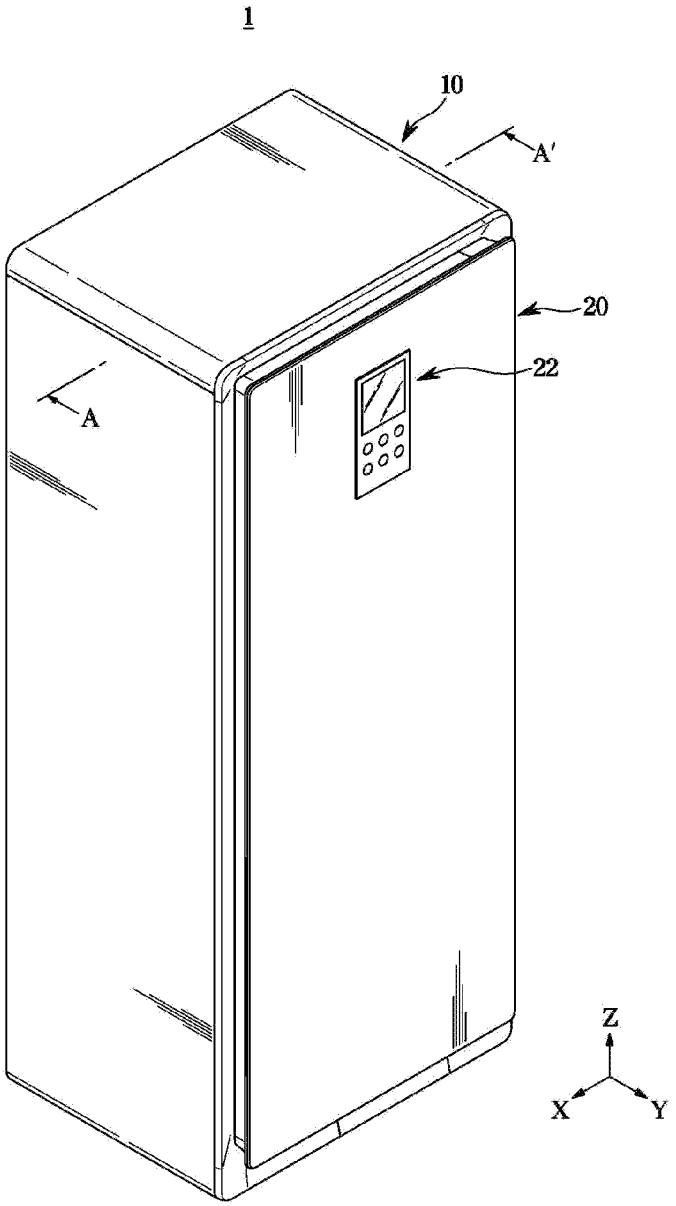
FIG. 1 is a diagram illustrating a shoe care apparatus according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function. Shapes and sizes of elements in the drawings may be exaggerated for clear description.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

The disclosure will be described more fully hereinafter with reference to the accompanying drawings. For convenience of description, a shoe care apparatus for caring for shoes is described as an example, but the shoe care apparatus according to one embodiment of the present disclosure may be used to care for clothes and/or miscellaneous goods other than shoes.

Embodiments of the present disclosure are directed to providing a shoe care apparatus capable of preventing foreign substances from entering a blow duct. Further, embodiments of the present disclosure are directed to providing a shoe care apparatus capable of having an increased usability.

Embodiments of the present disclosure may provide a shoe care apparatus including a cabinet forming a care chamber and including a supply port, a supply duct provided to supply air to the care chamber through the supply port, a supporter disposed in the care chamber and provided to communicate with the supply duct, and a supporter rail provided to allow the supporter to be detachably mounted thereon and arranged in the supply port. The supporter rail includes a supply door configured to open the supply port in response to being pressed by the supporter, and an elastic body provided to apply a force to the supply door to a direction of closing the supply port.

The supporter rail may include a trigger provided to be pressed by the supporter so as to rotate the supply door to a direction of opening the supply port in response to mounting the supporter.

The trigger may include a member formed to be more inclined from the supply door with respect to a direction, in which air is discharged from the supply port, as the supporter is along a direction of being coupled to the supporter rail.

The trigger may be arranged at a rear end of the supply door with respect to a direction in which the supporter is mounted.

The trigger may include a first member and a second member formed to protrude further from the supply door than the first member.

Embodiments of the present disclosure may provide a shoe care apparatus including a cabinet forming a care chamber and including a supply port, a supply duct provided to supply air to the care chamber through the supply port, a supporter disposed in the care chamber and provided to communicate with the supply duct, and a supporter rail arranged in the supply port, the supporter rail provided to allow the supporter to be detachably mounted thereon and including a mesh member provided to prevent foreign substances having a predetermined size or larger from passing through the supply port.

According to embodiments of the disclosure, a shoe care apparatus may open and close a blow duct depending on whether a supporter is mounted or not, thereby preventing foreign substances from entering the blow duct. According to embodiments of the disclosure, a shoe care apparatus may automatically open and close a blow duct depending on whether a supporter is mounted, and thus the convenience of use may be increased.

Figure 2:
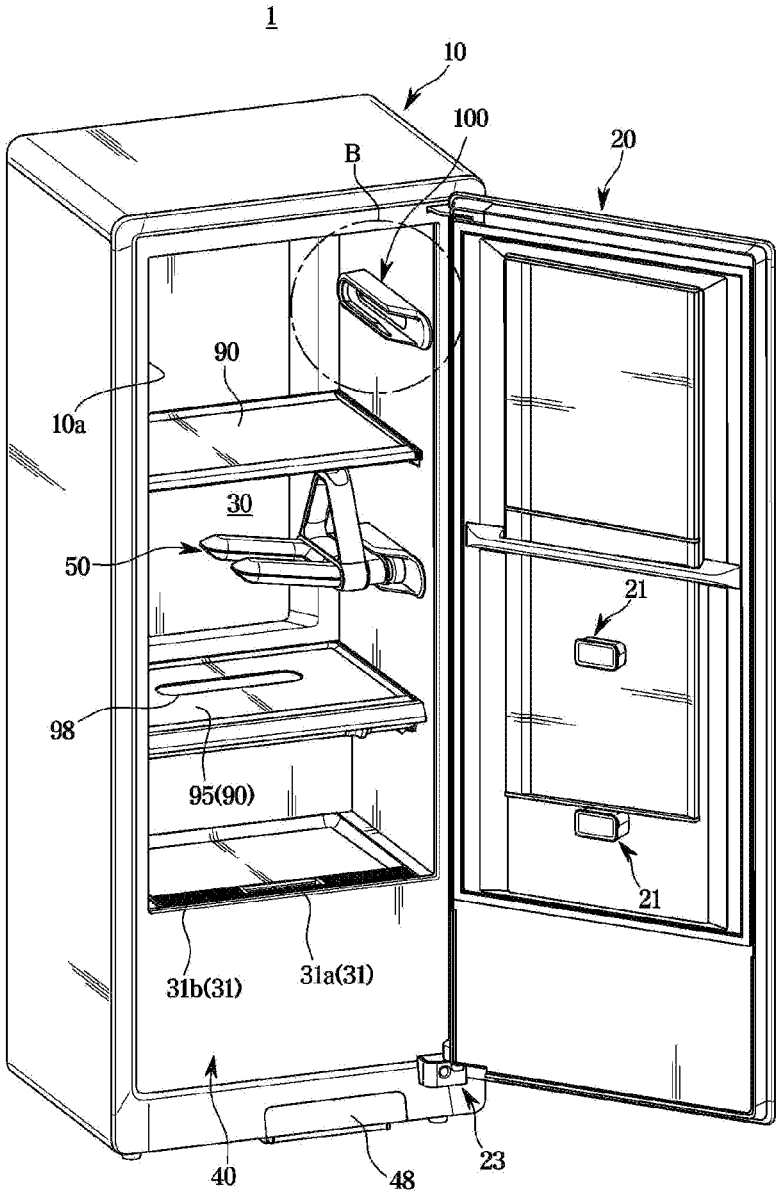
FIG. 2 is a view illustrating a state in which a cabinet door of the shoe care apparatus shown in FIG. 1 is opened according to an embodiment of the disclosure.
Figure 3:
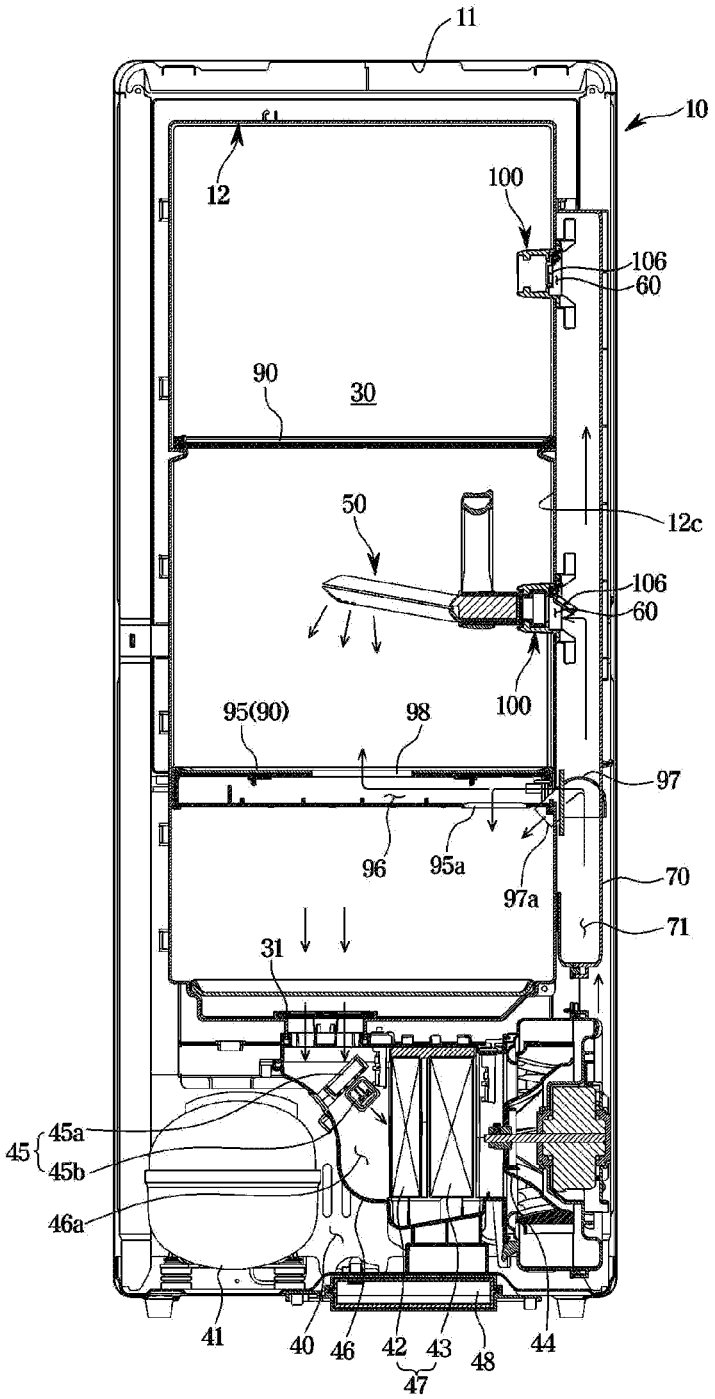
FIG. 3 is a sectional view taken along line A-A' of FIG. 1 according to an embodiment of the disclosure.

FIG. 1 is a diagram illustrating a shoe care apparatus according to one embodiment of the present disclosure. FIG. 2 is a view illustrating a state in which a cabinet door of the shoe care apparatus shown in FIG. 1 is opened. FIG. 3 is a sectional view taken along line A-A' of FIG. 1.

Referring to FIG. 1, a direction along the X-axis may be defined as a left and right direction, a direction along the Y-axis may be defined as a front and rear direction, and a direction along the −Z axis may be defined as an up and down direction.

Referring to FIGS. 1 to 3, a shoe care apparatus 1 according to one embodiment of the present disclosure may include a cabinet 10 forming an exterior and a cabinet door 20 rotatably coupled to the cabinet 10.

The cabinet 10 may have a rectangular parallelepiped shape with an open front surface. A cabinet opening 10*a* may be formed in an open front surface of the cabinet 10. The cabinet door 20 may be rotatably coupled to the cabinet 10 to open and close a care chamber 30 formed inside the cabinet 10. The cabinet door 20 may be coupled to the cabinet 10 through a hinge 23.

The cabinet door 20 may include a hanger 21 arranged on one surface that faces the inside of the care chamber when the cabinet door 20 closes the care chamber 30. At least one hanger 21 may be provided. The hanger 21 may be provided to allow a supporter 50, which is described later, to be hung thereon, thereby easily storing the supporter 50. The use of the hanger 21 is not limited thereto, and may be used to store other components.

The cabinet door 20 may further include an input device 22 arranged on a front surface of the shoe care apparatus 1. A user can set various care courses through the input device 22 based on the type of shoes for which to be cared.

The cabinet 10 may include an outer case 11 and an inner case 12 disposed inside the outer case 11. The inner case 12 may form the care chamber 30. The care chamber 30 may be provided to accommodate a plurality of shoes.

A machine room 40, in which a heat exchanger 47 for dehumidifying or heating air inside the care chamber 30 is arranged, may be provided in the cabinet 10.

The supporter 50 configured to support shoes may be provided inside the care chamber 30. The supporter 50 may be installed on one side of the care chamber 30. FIGS. 2 and 3 illustrate that the supporter 50 is located on the right side of the care chamber 30, but the position of the supporter 50 is not limited thereto. Alternatively, the supporter 50 may be located on the left side or on the rear inner side of the care chamber 30. The supporter 50 may be detachably provided in the cabinet 10. At least one supporter 50 may be provided. The supporter 50 may be formed in a shape that may be inserted into a shoe.

A drain pan 48 detachably provided to the cabinet 10 may be installed at a lower portion of the cabinet 10. The drain pan 48 may be disposed under the care chamber 30. The drain pan 48 may be provided to easily collect condensed water generated by the heat exchanger 47.

The drain pan 48 may be provided under the machine room 40. The machine room 40 may be located at the lower end of the cabinet 10. The machine room 40 may be provided under the care chamber 30.

The heat exchanger 47 may be configured to dehumidify and/or heat the air inside the care chamber 30 as needed.

The heat exchanger 47 may be configured to supply hot dry air to the inside of the care chamber 30. The heat exchanger 47 may include an evaporator 42 and a condenser 43 through which a refrigerant circulates. The heat exchanger 47 may be configured to dehumidify and/or heat the air.

As the refrigerant passing through the evaporator 42 absorbs latent heat from the surrounding air, the evaporator 42 may condense and remove moisture from the surrounding air. The refrigerant passing through the evaporator 42 is changed to a high-temperature and high-pressure state while passing through the compressor 41. As the high-temperature and high-pressure refrigerant is condensed by passing through the condenser 43, the condenser 43 may heat the surrounding air by releasing latent heat toward the surrounding air. Air introduced into the machine room 40 through a fan 44 may be dehumidified and heated by passing through the evaporator 42 and the condenser 43.

The fan 44 may be provided as a centrifugal fan that sucks air in a rotation axis direction and discharges air in a radial direction. However, the type of fan 44 is not limited thereto, and may be provided as an axial flow fan or a mixed flow fan.

A connection flow path 46*a*, through which air passing through the evaporator 42, the condenser 43, and the blower fan 44 flows, may be formed in the machine room 40. The connection flow path 46*a* may be formed by a connection duct 46. The connection duct 46 may communicate with the care chamber 30.

The shoe care apparatus 1 may further include a water tank (not shown), a steam generator (not shown) configured to generate steam by receiving water from the water tank, and a steam spraying device (not shown) configured to receive steam from the steam generator and spray the steam.

The water tank may be disposed under the care chamber 30. Water in the water tank may be supplied to the steam generator and used to form steam. The water tank may be installed to be detached from the cabinet 10 to facilitate water replenishment.

The steam generator may be disposed in the machine room 40. The steam generator may generate steam and guide the steam to the steam spraying device. The steam generator may be connected to the steam spraying device through a steam supply pipe (not shown).

The shoe care apparatus 1 may further include a deodorizer 45. The deodorizer 45 may be disposed within the machine room 40. The deodorizer 45 may be disposed in the connection duct 46 to remove odors from the air passing through the care chamber 30. In FIG. 3, the deodorizer 45 is illustrated as being located on the left side of the blower fan 44, but is not limited thereto. Alternatively, the deodorizer 45 may be located on the right side of the blower fan 44.

The deodorizer 45 may include a deodorizing filter 45*a* and a germicidal lamp 45*b*. The deodorizing filter 45*a* may include a ceramic filter. The germicidal lamp 45*b* may include an ultraviolet lamp. However, the deodorizing filter is not limited thereto, and the deodorizing filter 45*a* may include various filters as long as a filter is configured to remove odors from the air, and the germicidal lamp 45*b* may also include various devices as long as a device is configured to sterilize germs.

At least one plate 90 may be provided in the care chamber 30. The plate 90 may be provided to hold shoes. A supply port 60 and the supporter 50 may be positioned adjacent to the plate 90.

The plate 90 may include a duct plate 95. The duct plate 95 may include an internal flow path 96 as shown in FIG. 3. The heated air passing through the internal flow path 96 may be sprayed toward shoes from a spray port 95*a* of the duct plate 95 and a spray port 97*a* of a circular duct 97, respectively. In addition, the heated air may pass through the internal flow path 96 and be discharged to the care chamber 30 through a plate outlet 98.

The supply port 60 and a return port 31 may be provided in the care chamber 30.

The supply port 60 may be located on a side wall of the inner case 12. Particularly, the supply port 60 may be formed on the left surface, in which the supporter 50 is located, of the care chamber 30. However, the position of the supply port 60 is not limited thereto, and may be formed on the right side of the care chamber 30 as long as the position corresponds to the position of the supporter 50. At least one supply port 60 may be formed, and shoes may be dried by supplying heated air into the care chamber 30. The shape of the supply port 60 may be approximately circular. However, the shape of the supply port 60 is not limited thereto, and as long as the supply port is provided to supply heated air into the care chamber 30 so as to dry shoes, the support port 60 may have various shapes such as squares and polygons.

The return port 31 may be disposed at the front end of the bottom surface of the care chamber 30. However, the position of the return port 31 is not limited thereto, and may also be disposed at the rear end and/or the side end of the bottom surface of the care chamber 30. Air drying shoes in the care chamber 30 may be returned to the connection duct 46 to be described later through the return port 31. A return hole 31*a* and a return grille 31*b* may be provided in the return port 31.

The connection duct 46 may be provided to communicate with a supply duct 70 and the return port 31 of the care chamber 30. One end of the connection duct 46 may communicate with the supply duct 70 and the other end may communicate with the return port 31. The air introduced through the return port 31 may be dehumidified and/or heated while passing through the connection duct 46, and then the dehumidified and/or heated air may be discharged back to the care chamber 30 through the supply duct 70 and the supply port 60.

The supply duct 70 may be provided to extend vertically between the outer case 11 and the inner case 12 of the cabinet 10. The supply duct 70 may be located on one side, to which the supporter 50 is mounted, of the cabinet 10. One end of the supply duct 70 may communicate with the connection duct 46. The supply duct 70 may be provided to communicate with the supply port 60. The supply duct 70 may form a guide flow path 71 provided to guide heated air to the supply port 60.

A supporter rail 100 detachably supporting the supporter 50 may be provided in the care chamber 30.

The supporter 50 may be detachably mounted on the supporter rail 100 provided on one side of the inner case 12. Particularly, the supporter 50 and the supporter rail 100 may be located on the right side of the care chamber 30.

The supporter 50 may be mounted on the supporter rail 100 along the front and rear direction. The supporter 50 may be disposed to allow a lateral side of the shoe, which is mounted thereon, to face the front of the shoe care apparatus 1.

Because the supporter 50 is separated from the care chamber 30, a space in the care chamber 30 may be secured for caring for relatively long shoes.

Figure 4:
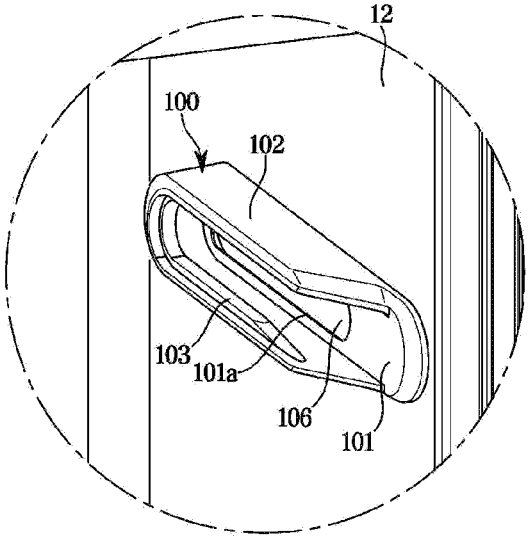
FIG. 4 is an enlarged view of part B of FIG. 2 according to an embodiment of the disclosure.
Figure 5:
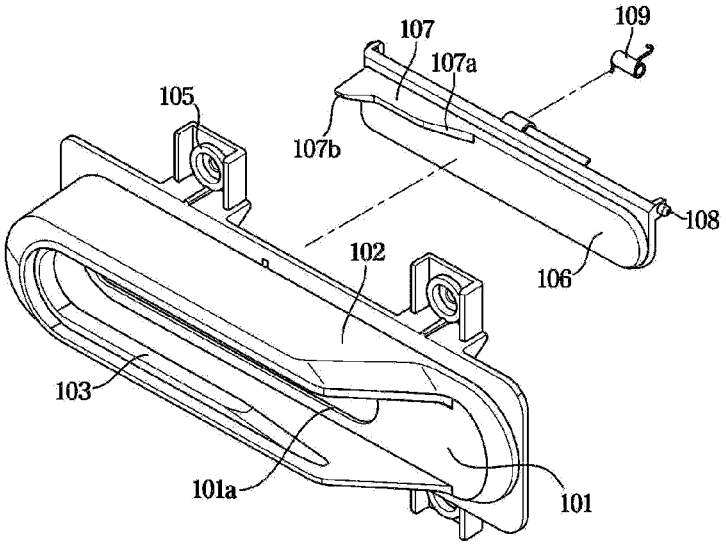
FIG. 5 is an exploded view of a supporter rail of FIG. 4 according to an embodiment of the disclosure.
Figure 6:
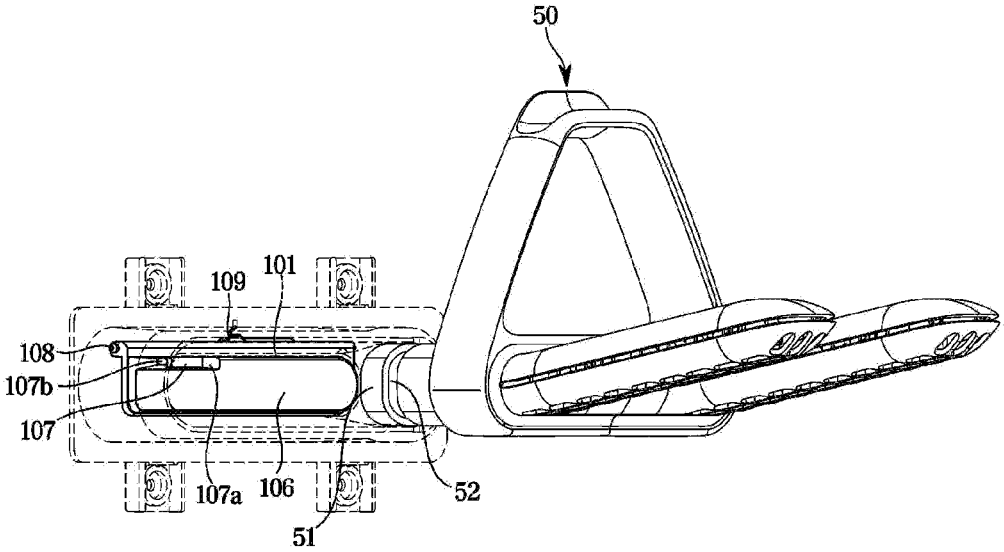
FIG. 6 is a view illustrating a state in which a supporter of FIG. 2 starts to be mounted on the supporter rail according to an embodiment of the disclosure.
Figure 7:
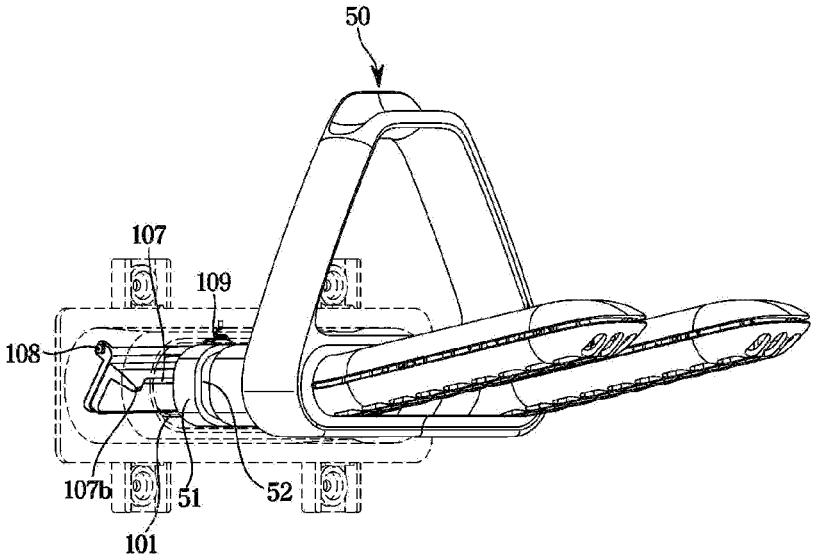
FIG. 7 is a view illustrating a state in which the supporter of FIG. 6 opens a supply door while being mounted on the supporter rail according to an embodiment of the disclosure.
Figure 8:
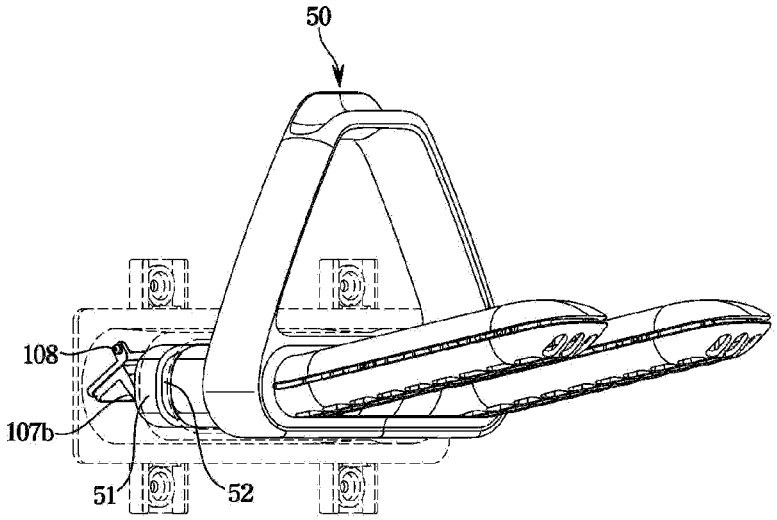
FIG. 8 is a view illustrating a state in which the supporter of FIG. 7 completely opens the supply door while being completely mounted on the supporter rail according to an embodiment of the disclosure.

FIG. 4 is an enlarged view of part B of FIG. 2. FIG. 5 is an exploded view of the supporter rail of FIG. 4. FIG. 6 is a view illustrating a state in which a supporter of FIG. 2 starts to be mounted on the supporter rail. FIG. 7 is a view illustrating a state in which the supporter of FIG. 6 opens a supply door while being mounted on the supporter rail. FIG. 8 is a view illustrating a state in which the supporter of FIG. 7 completely opens the supply door while being completely mounted on the supporter rail.

Referring to FIGS. 4 and 5, the supporter rail 100 may include a rail body 101 fixed to the inner case 12. The rail body 101 may include a fixer 105 coupled to a fixing member (not shown) and fixed to the inner case 12.

The rail body 101 may include a rail opening 101*a* formed to communicate with the supply port 60. The rail opening 101*a* may be formed to pass through the rail body 101. The rail opening 101*a* may be opened and closed by a supply door 106.

The supporter rail 100 may include a supporter supporting member 102 formed to support the supporter 50 when the supporter 50 is mounted. The supporter supporting member 102 may protrude from the rail body 101.

A guide rail 103 may be formed on the supporter rail 100 to guide the supporter 50 when the supporter 50 is mounted on or separated from the supporter rail 100. The guide rail 103 may protrude from the supporter supporting member 102. The guide rail 103 may extend along a direction in which the supporter 50 is mounted on the supporter rail 100 or a direction in which the supporter 50 is separated from the supporter rail 100.

The supporter rail 100 may include the supply door 106. The supply door 106 may be rotatably coupled to the rail body 101. The supply door 106 may include a door shaft 108 rotatably coupled to the rail body 101. The supply door 106 may be configured to open and close the rail opening 101*a*.

The supporter rail 100 may include an elastic body 109 provided to elastically bias the supply door 106 to a direction of closing the rail opening 101*a*. The elastic body 109 may press the supply door 106 to the direction of closing the rail opening 101*a*. The elastic body 109 may be provided as a spring.

The supply door 106 may include a trigger 107 formed to interfere with the supporter 50 when the supporter 50 is mounted on the supporter rail 100. The trigger 107 may be pressed by the supporter 50 to a direction in which the supply door 106 is opened when the supporter 50 is mounted. The trigger 107 may extend along a direction in which air is discharged from the supply door 106.

The trigger 107 may include a first member 107*a* in which a pressure by the supporter 50 starts when the supporter 50 is mounted. The first member 107*a* may be more inclined, with respect to a direction away from the supply door 106, as the supporter is along a direction of being mounted to the supporter rail. Accordingly, when the supporter 50 is mounted on the supporter rail 100, the supply door 106 may be gradually opened as the supporter 50 presses the first member 107*a* of the trigger 107 and moves.

The trigger 107 may include a second member 107*b* that extends further from the supply door 106 than the first member 107*a*. The second member 107*b* may be disposed to be pressed by the supporter 50 when the supporter 50 is completely mounted to the supporter rail 100. The second member 107*b* of the trigger 107 may be provided to further open the supply door 106 than when the supporter 50 presses the first member 107*a*.

An operation of the supply door 106 according to one embodiment of the present disclosure will be described with reference to FIGS. 6 to 8.

Referring to FIG. 6, the supporter 50 may include a guide 52 into which the guide rail 103 is inserted. The guide 52 may include a member extending along a direction in which the supporter 50 is mounted on the supporter rail 100. The supporter 50 may include a pressing member 51 provided to press the trigger 107. The pressing member 51 may be inserted into the supporter supporting member 102.

Referring to FIG. 7, as the supporter 50 is inserted into the supporter rail 100, the pressing member 51 presses the first member 107*a* of the trigger 107. Accordingly, the supply door 106 is rotated by a predetermined angle and opens the rail opening 101*a*.

Referring to FIG. 8, as the supporter 50 is completely mounted on the supporter rail 100, the pressing member 51 presses the second member 107*b* of the trigger 107. Accordingly, the supply door 106 is further rotated by a predetermined angle and completely opens the rail opening 101*a*. Accordingly, the supply port 60 may be opened.

When the supporter 50 is separated from the supporter rail 100, the pressing member 51 releases the pressure of the trigger 107. The elastic body 109 applies an elastic force to the supply door 106 to the direction in which the supply door 106 closes the rail opening 101*a*. Accordingly, the supply door 106 is rotated to a position to close the rail opening 101*a* as the supporter 50 is separated from the supporter rail 100. Therefore, the supply port 60 may be closed.

With this configuration, the supporter rail 100 according to one embodiment of the present disclosure may discharge the air, which is guided through the guide flow path 71, to the care chamber 30 through the supporter 50 when the supporter 50 is mounted. Further, the supporter rail 100 may prevent foreign substances from entering the guide flow path 71 when the supporter 50 is separated.

Figure 9:
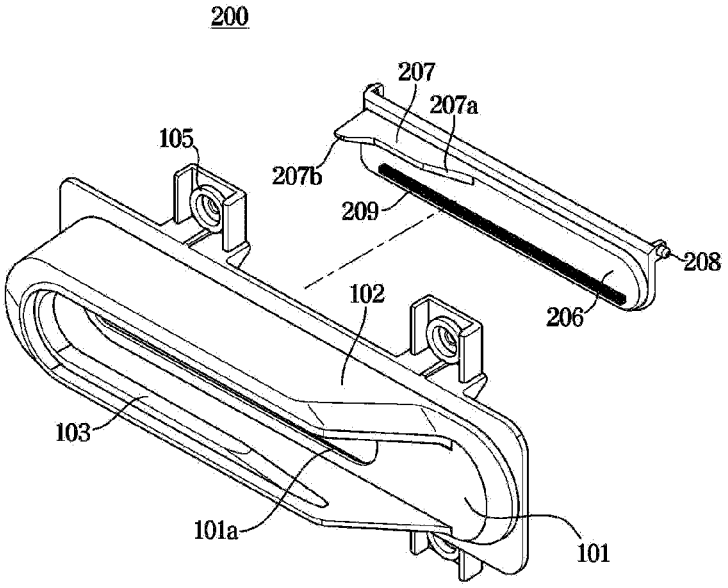
FIG. 9 is an exploded view of a supporter rail according to another embodiment of the disclosure.

FIG. 9 is an exploded view of a supporter rail according to another embodiment of the present disclosure.

A supporter rail 200 according to another embodiment of the present disclosure will be described with reference to FIG. 9. However, the same reference numerals are assigned to the same components as those of the supporter rail 100 shown in FIGS. 4 and 5, and detailed descriptions thereof may be omitted.

Referring to FIG. 9, the supporter rail 200 according to another embodiment of the present disclosure may include a supply door 206 rotatably coupled to the rail body 101. The supply door 206 may include a door shaft 208 rotatably coupled to the rail body 101. The supply door 206 may include a trigger 207 provided to be pressed by the supporter 50 so as to gradually open the supply door 206. The trigger 207 may include a first member 207*a* primarily opening the supply door 206 and a second member 207*b* secondarily opening the supply door 206.

Unlike the supply door 106 according to the embodiment shown in FIGS. 4 and 5, the supply door 206 according to the embodiment shown in FIG. 9 may include a weight member 209. The weight member 209 may be located at a lower end of the supply door 206.

The weight member 209 may be provided to rotate the supply door 206 to a direction of closing the rail opening 101*a* when the supporter 50 is separated from the supporter rail 200. Accordingly, the supply port 60 may be closed. The weight member 209 may be provided to have a heavier weight than other parts of the supply door 206.

With this configuration, the supporter rail 200 according to another embodiment of the present disclosure may discharge the air, which is guided through the guide flow path 71, to the care chamber 30 through the supporter 50 when the supporter 50 is mounted. Further, the supporter rail 200 may prevent foreign substances from entering the guide flow path 71 when the supporter 50 is separated.

Figure 10:
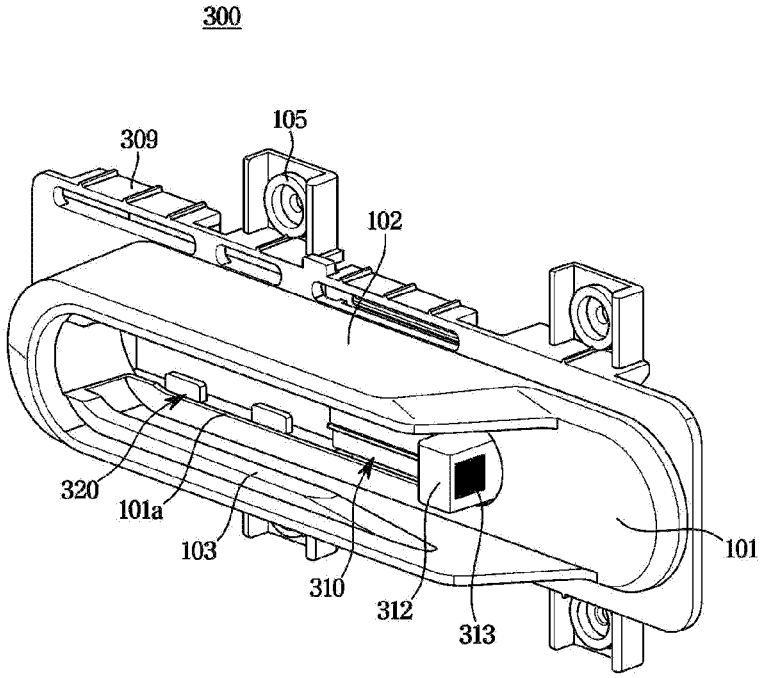
FIG. 10 is a view of a supporter rail according to still another embodiment of the disclosure.
Figure 11:
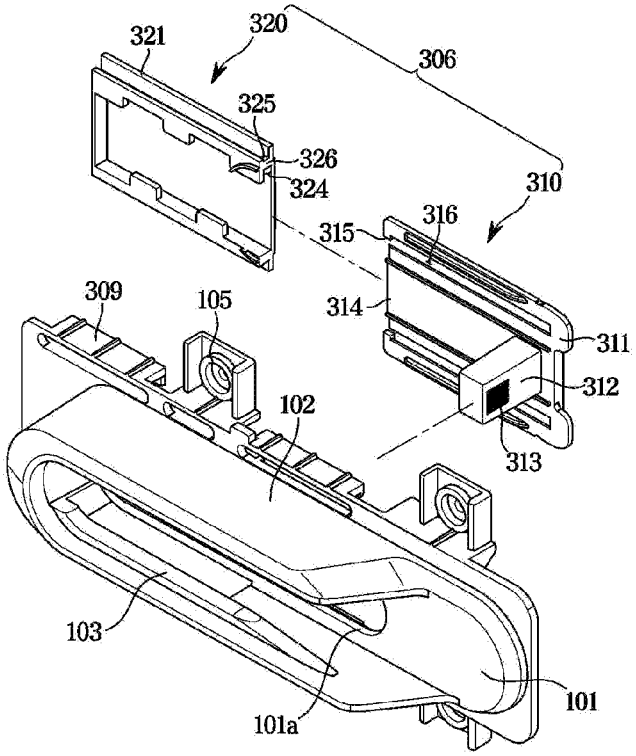
FIG. 11 is an exploded view of the supporter rail of FIG. 10 according to an embodiment of the disclosure.
Figure 12:
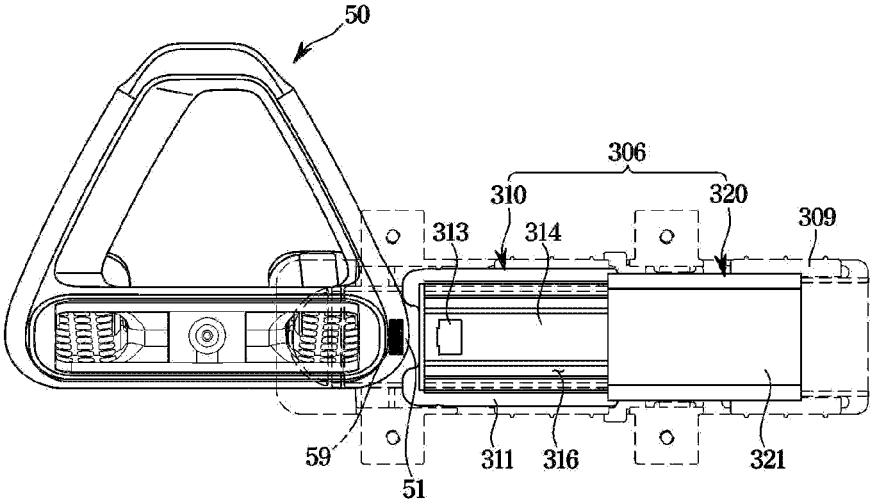
FIG. 12 is a view illustrating a state in which a supporter of FIG. 10 starts to be mounted on the supporter rail according to an embodiment of the disclosure.
Figure 13:
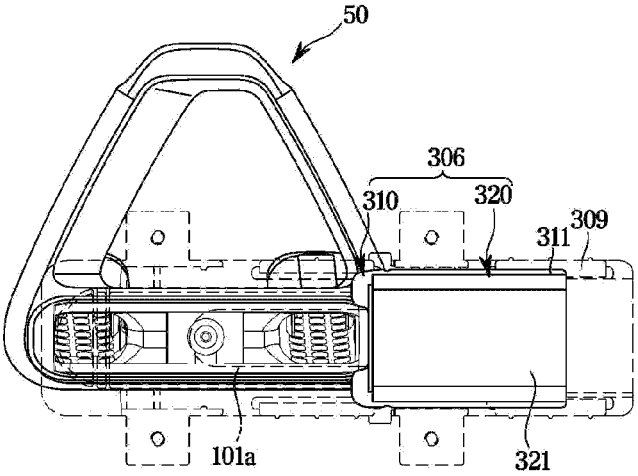
FIG. 13 is a view illustrating a state in which the supporter of FIG. 12 opens a first shutter of a supply door while being mounted on the supporter rail according to an embodiment of the disclosure.
Figure 14:
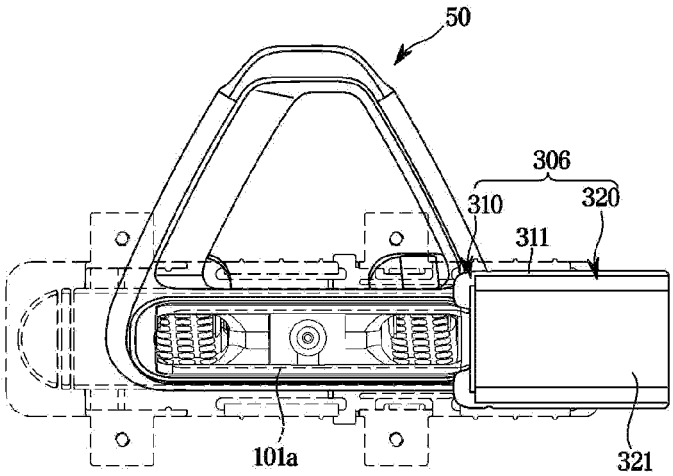
FIG. 14 is a view illustrating a state in which the supporter of FIG. 13 completely opens a second shutter of the supply door while being completely mounted on the supporter rail according to an embodiment of the disclosure.
Figure 15:
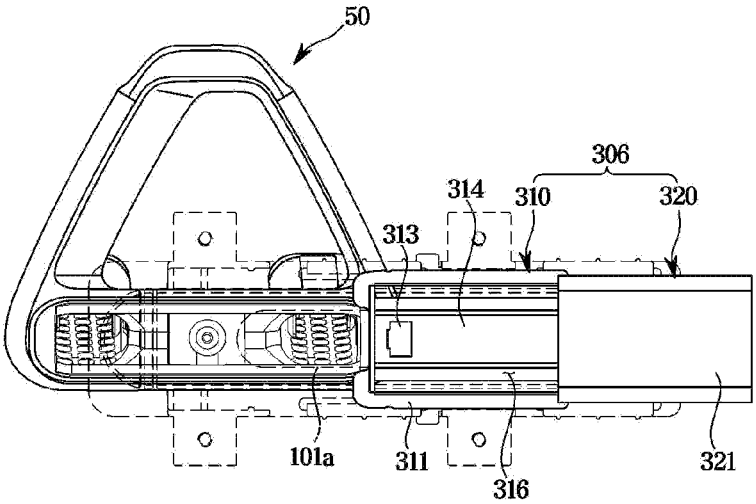
FIG. 15 is a view illustrating a state in which the supporter of FIG. 14 is moved to a direction in which the first shutter of the supporter rail is closed, while being separated from the supporter rail, according to an embodiment of the disclosure.
Figure 16:
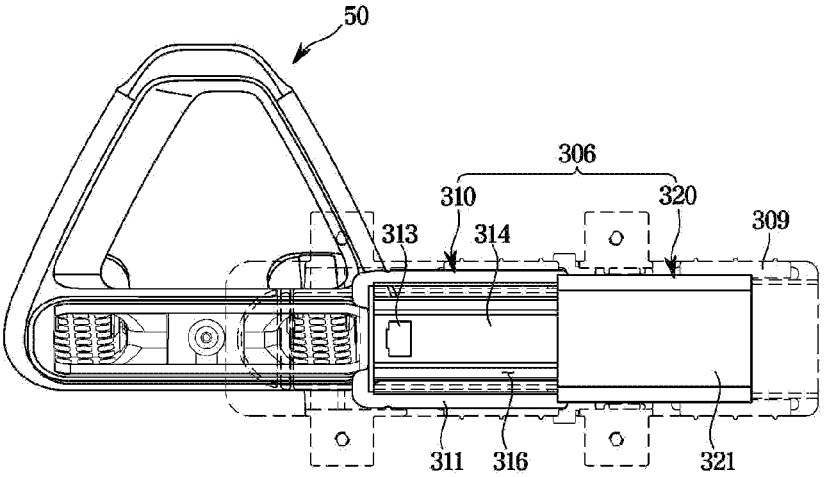
FIG. 16 is a view illustrating a state in which the supporter of FIG. 15 is moved to a direction in which the second shutter is closed, as being moved to the direction, in which the first shutter of the supporter rail is closed while being separated from the supporter rail, according to an embodiment of the disclosure.

FIG. 10 is a view of a supporter rail according to still another embodiment of the present disclosure. FIG. 11 is an exploded view of the supporter rail of FIG. 10. FIG. 12 is a view illustrating a state in which the supporter of FIG. 10 starts to be mounted on the supporter rail. FIG. 13 is a view illustrating a state in which the supporter of FIG. 12 opens a first shutter of a supply door while being mounted on the supporter rail. FIG. 14 is a view illustrating a state in which the supporter of FIG. 13 completely opens a second shutter of the supply door while being completely mounted on the supporter rail. FIG. 15 is a view illustrating a state in which the supporter of FIG. 14 is moved to a direction, in which the first shutter of the supporter rail is closed, while being separated from the supporter rail. FIG. 16 is a view illustrating a state in which the supporter of FIG. 15 is moved to a direction, in which the second shutter is closed, as being moved to the direction, in which the first shutter of the supporter rail is closed while being separated from the supporter rail.

A supporter rail 300 according to still another embodiment of the present disclosure will be described with reference to FIGS. 10 to 16. The same reference numerals are assigned to the same components as those of the embodiment shown in FIGS. 4 and 5, and detailed descriptions thereof may be omitted.

Referring to FIGS. 10 and 11, the supporter rail 300 according to still another embodiment of the present disclosure may include a supply door 306 configured to open and close the rail opening 101*a* of the rail body 101. The supply door 306 may be slidably coupled to the rail body 101. The rail body 101 may include a door supporting member 309 provided to slidably support the supply door 306. The supply door 306 may include a first shutter 310 and a second shutter 320.

The first shutter 310 may be slidably coupled to the second shutter 320. The first shutter 310 may include a first shutter body 311 and a lever 312 protruding from the first shutter body 311 to interfere with the supporter 50 when the supporter 50 is coupled. The lever 312 may penetrate the rail opening 101*a* and extend to a space between the supporter supporting member 102.

A magnetic material 313 may be provided on the lever 312. The magnetic material 313 may have magnetism capable of sticking to a magnet 59 provided on the supporter 50. Alternatively, a magnet may be provided on the lever 312 and a magnetic material may be provided on the supporter 50.

The first shutter body 311 may include a first insertion member 314, a first hook 315, and a guide slit 316.

The first insertion member 314 may be slidably inserted into an insertion space 324 of a second shutter body 321. The first hook 315 may be provided to interfere with a second hook 325 of the second shutter body 321. As the first hook 315 interferes with the second hook 325, the first shutter 310 may be prevented from being separated from the second shutter 320. A second insertion member 326 of the second shutter body 321 may be slidably inserted into the guide slit 316.

The second shutter 320 may be slidably coupled to the first shutter 310. The second shutter 320 may include the second shutter body 321.

The second shutter body 321 may include the insertion space 324, the second hook 325, and the second insertion member 326.

The first insertion member 314 of the first shutter body 311 may be slidably inserted into the insertion space 324. One side of the insertion space 324 into which the first insertion member 314 is inserted may be opened and the other side of the insertion space 324 may be closed. Accordingly, the insertion space 324 may be provided to prevent the first shutter body 311 from being separated from the second shutter body 321. When the first shutter body 311 moves in the direction of being separated from the second shutter body 321, the second hook 325 may support the first hook 315 so as to prevent the first shutter body 311 from being separated from the second shutter body 321. The second insertion member 326 may be slidably inserted into the guide slit 316 of the first shutter body 311.

With this configuration, the supply door 306 may sequentially open the rail openings 101*a*.

An operation of the supporter rail 300 according to still another embodiment of the present disclosure will be described with reference to FIGS. 12 to 16.

Referring to FIG. 12, the supporter 50 may include the magnet 59 positioned adjacent to the pressing member 51.

Referring to FIG. 13, when the supporter 50 is coupled to the rail body 101, the pressing member 51 of the supporter 50 presses the lever 312 of the first shutter 310, and moves the first shutter 310 to allow the rail opening 101*a* to be opened. The first shutter 310 slides relative to the second shutter 320. The second shutter 320 maintains a stopped state.

Referring to FIG. 14, as the supporter 50 is completely mounted on the rail body 101, the first shutter 310 may move the second shutter 320 to completely open the rail opening 101*a*. Accordingly, the supply port 60 may be opened. As the first insertion member 314 of the first shutter body 311 presses the closed one end of the insertion space 324 of the second shutter body 321, the second shutter 320 is moved together with the first shutter 310. Because the first shutter 310 is provided to overlap the second shutter 320, the supply door 306 according to still another embodiment of the present disclosure may reduce a space occupied when the rail opening 101*a* is opened.

Referring to FIG. 15, when the supporter 50 starts to be separated from the rail body 101, the first shutter 310 may be moved to the direction of closing the rail opening 101*a* as the magnetic material 313 is pulled by a magnetic force of the magnet 59 provided on the supporter 50. That is, the first shutter 310 may be moved together with the supporter 50 by the attraction caused by the magnetic force generated between the pressing member 51 of the supporter 50 and the lever 312.

Referring to FIG. 16, as the supporter 50 is moved to be completely separated from the rail body 101, the first shutter 310 may move the second shutter 320, thereby completely closing the rail opening 101*a*. As the first hook 315 of the first shutter body 311 is hooked to the second hook 325 of the second shutter body 321, the second shutter 320 may be moved together with the first shutter 310, which is moved by the magnetic force of the magnet 59 of the supporter 50, to the direction of closing the rail opening 101*a*. Accordingly, the supply port 60 may be closed.

With this configuration, the supporter rail 300 according to still another embodiment of the present disclosure may discharge the air, which is guided through the guide flow path 71, to the care chamber 30 through the supporter 50 when the supporter 50 is mounted. Further, the supporter rail 300 may prevent foreign substances from entering the guide flow path 71 when the supporter 50 is separated.

Figure 17:
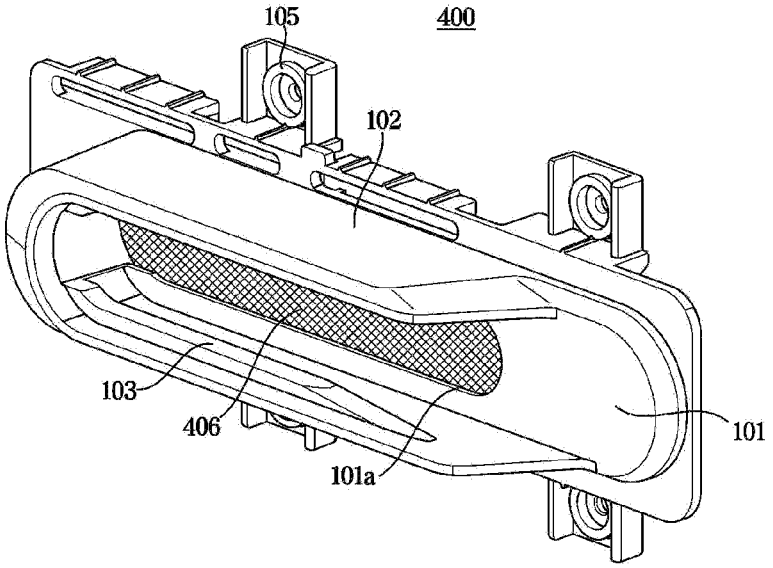
FIG. 17 is a view of a supporter rail according to still another embodiment of the disclosure.

FIG. 17 is a view of a supporter rail according to still another embodiment of the present disclosure.

Referring to FIG. 17, a supporter rail 400 according to still another embodiment of the present disclosure will be described. However, the same references are assigned to the same components as those of the embodiment shown in FIGS. 4 and 5, and detailed descriptions thereof may be omitted.

Referring to FIG. 17, a supporter rail 400 according to still another embodiment of the present disclosure may include a mesh member 406 positioned in the rail opening 101*a*. The mesh member 406 may be provided to prevent foreign substances from entering the guide flow path 71 through the rail opening 101*a* and at the same time, provided to discharge the air, which is guided through the guide flow path 71, to the care chamber through the supporter 50. The mesh member 406 may be formed to prevent foreign substances having a predetermined size or larger from passing therethrough.

With this configuration, the supporter rail 400 according to still another embodiment of the present disclosure may discharge the air, which is guided through the guide flow path 71, to the care chamber 30 through the supporter 50 when the supporter 50 is mounted. Further, the supporter rail 400 may prevent foreign substances from entering the guide flow path 71 when the supporter 50 is separated.

While the present disclosure has been particularly described with reference to exemplary embodiments, it should be understood by those of skilled in the art that various changes in form and details may be made without departing from the spirit and scope of the present disclosure.

What is claimed is:

1. A shoe care apparatus, comprising:

a cabinet forming a care chamber and including a supply port;

a supply duct provided to supply air to the care chamber through the supply port;

a supporter rail including a guide rail; and a supporter to support a shoe, and being detachably mountable to the supporter rail in the care chamber, wherein the supporter rail and supporter are configured so that the supply port is opened in response to the supporter being guided by the guide rail and mounted to the supporter rail, and the supporter receives the air supplied through the supply port, and the supply port is closed in response to the supporter being guided by the guide rail and separated from the supporter rail.

2. The shoe care apparatus of claim 1, wherein the supporter rail includes:

a rail body fixed to the cabinet, and a supply door coupled to the rail body so as to be rotatable to open the supply port and close the supply port.

3. The shoe care apparatus of claim 2, wherein the supporter rail further includes:

an elastic body provided to apply an elastic force to the supply door in a direction to close the supply port.

4. The shoe care apparatus of claim 2, wherein the supply door includes:

a weight member arranged on a lower end of the supply door so as to rotate the supply door in a direction to close the supply port.

5. The shoe care apparatus of claim 2, wherein the supporter rail further includes:

a trigger provided to be pressed by the supporter so as to rotate the supply door in a direction to open the supply port in response to the supporter being mounted to the supporter rail.

6. The shoe care apparatus of claim 5, wherein the trigger includes:

a member formed to extend from the supply door in a direction in which air is discharged from the supply port, and to be inclined in a direction along which the supporter moves while being mounted to the supporter rail.

7. The shoe care apparatus of claim 5, wherein the trigger is arranged at a rear end of the supply door with respect to a direction along which the supporter moves while being mounted to the supporter rail.

8. The shoe care apparatus of claim 5, wherein the trigger includes:

a first member, and a second member formed to protrude further from the supply door than the first member.

9. The shoe care apparatus of claim 1, wherein the supporter rail includes:

a rail body fixed to the cabinet, and a supply door coupled to the rail body so as to be slidable to open the supply port and close the supply port.

10. The shoe care apparatus of claim 9, wherein the supply door includes:

a first shutter including a lever provided to be pressed by the supporter in response to mounting the supporter to the supporter rail, and a second shutter slidably coupled to the first shutter.

11. The shoe care apparatus of claim 10, wherein the supporter includes:

a pressing member provided to press the lever, and at least one of a magnet and a magnetic material disposed in the pressing member, wherein at least one of the magnetic material and the magnet is provided in the lever to apply an attractive force between the lever and the pressing member.

12. The shoe care apparatus of claim 10, wherein the first shutter includes a hook provided to interfere with a portion of the second shutter to prevent the first shutter from being separated from the second shutter when the supporter is being separated from the supporter rail.

13. The shoe care apparatus of claim 10, wherein the first shutter is provided to overlap the second shutter in response to the supply port being opened as the supporter is mounted on the supporter rail.

14. The shoe care apparatus of claim 9, wherein the rail body includes a door supporting member provided to support the supply door so as to be slidable.

15. A shoe care apparatus, comprising:

a cabinet forming a care chamber and including a supply port;

a supply duct provided to supply air to the care chamber through the supply port;

a supporter rail including:

a rail body fixed to the cabinet, and a supply door coupled to the rail body so as to be rotatable to open the supply port and close the supply port; and a supporter to support a shoe, and being detachably mountable to the supporter rail in the care chamber, wherein the supporter rail and supporter are configured so that the supply port is opened in response to the supporter being mounted to the supporter rail, and the supporter receives the air supplied through the supply port, and the supply port is closed in response to the supporter being separated from the supporter rail.

16. A shoe care apparatus, comprising:

a cabinet forming a care chamber and including a supply port;

a supply duct provided to supply air to the care chamber through the supply port;

a supporter rail including:

a rail body fixed to the cabinet, and a supply door coupled to the rail body so as to be slidable to open the supply port and close the supply port; and a supporter to support a shoe, and being detachably mountable to the supporter rail in the care chamber, wherein the supporter rail and supporter are configured so that the supply port is opened in response to the supporter being mounted to the supporter rail, and the supporter receives the air supplied through the supply port, and the supply port is closed in response to the supporter being separated from the supporter rail.

* * * * *